US007802941B2

(12) United States Patent
Wingo et al.

(10) Patent No.: US 7,802,941 B2
(45) Date of Patent: Sep. 28, 2010

(54) RUT RESISTANT COATING AND METHOD OF APPLYING RUT RESISTANT COATING

(75) Inventors: Jon Brett Wingo, Broken Arrow, OK (US); Marvin Keller Exline, Terre Haute, IN (US); James Joseph Cunningham, Jr., Greensburg, PA (US)

(73) Assignee: Road Science, L.L.C., Tulsa, OK (US)

( * ) Notice: Subject to any disclaimer, the term of this patent is extended or adjusted under 35 U.S.C. 154(b) by 312 days.

(21) Appl. No.: 12/110,821

(22) Filed: Apr. 28, 2008

(65) Prior Publication Data

US 2009/0269134 A1 Oct. 29, 2009

(51) Int. Cl.
*E01C 3/06* (2006.01)

(52) U.S. Cl. ..... 404/82; 404/17; 404/75

(58) Field of Classification Search ..... 404/17, 404/72, 75, 82
See application file for complete search history.

(56) References Cited

U.S. PATENT DOCUMENTS 4,828,428 A * 5/1989 Anderson ..... 404/102
4,915,539 A * 4/1990 Yoshikane et al. ..... 404/31
4,944,632 A 7/1990 Dillingham
5,069,578 A 12/1991 Bense
5,131,788 A 7/1992 Hulicsko
5,851,085 A 12/1998 Campbell
6,830,408 B1 * 12/2004 Blankenship et al. ..... 404/17

FOREIGN PATENT DOCUMENTS

FR 2716470 8/1995
WO 8103039 10/1981

OTHER PUBLICATIONS

J. Don Brock and Jim Hedderich, Pavement Smoothness, Technical Paper T-123, Hamilton County, Tennessee.
Roadtec, SP-200 Spray Paver, flyer, Hamilton County, Tennessee.
Roadtec, SP-200 Specifications, sales brochure, 2005, Chattanooga, Tennessee.

* cited by examiner

*Primary Examiner*—Raymond W Addie
(74) *Attorney, Agent, or Firm*—Head, Johnson & Kachigian, P.C.

(57) ABSTRACT

The present invention is directed to a rut resistant coating and a method for applying the rut resistant coating on an existing surface for increasing resistance to high vertical and horizontal strains and high shear stresses. The method includes applying a binding material layer of the rut resistant coating on the existing surface to provide a substantially impermeable moisture barrier to the existing surface, the binding material layer containing less than about 11% of the total binding material of the rut resistant coating. After applying the binding material layer, an aggregate mixture layer is applied on the binding material layer to provide the wear surface of the rut resistant coating and support and structure to the rut resistant coating to resist rutting, the aggregate mixture layer containing an asphalt solution.

23 Claims, No Drawings

RUT RESISTANT COATING AND METHOD OF APPLYING RUT RESISTANT COATING

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

1. Field of the Invention

The present invention relates to a surface coating applied to an existing surface, and more particularly, not by way of limitation, to a rut resistant coating on an existing surface and a method for applying the rut resistant coating on the existing surface to increase resistance to rutting caused by lateral movement of the pavement materials due to high shear stresses caused by traffic. In addition, the rut resistant coating of the present invention provides increased resistance to high vertical and horizontal strains caused by cracks or irregularities in the existing surface.

2. Description of the Related Art

It is desirable to place a new surface or a new pavement over existing pavement used to construct roads, parking lots, airport runways, airport taxiways, and the like and not have existing cracks reappear in the new pavement for long periods of time. Cracks in the existing pavement are a form of distress, which can lead to premature failure of the new pavement. The cracks allow moisture (i.e. water) to enter into the existing (i.e. underlying) pavement and create structural support issues. Additionally, the cracks can also create ride quality issues, which may require grinding to smoothing, time intensive crack filing operations to seal the pavement, or significant costs to apply one or more additional pavement layers to address the problem.

It is common for pavements to crack during their expected service life. Reflective cracks occur when a pavement layer is placed over an existing cracked pavement. The existing cracks transmit into the new pavement after a period of time. These cracks in the new pavement can be created by several mechanisms, one of which is thermal stress. The pavement cracks form when asphalt in the pavement hardens from aging to the point that it cannot relieve the stress as the pavement tries to bend from the differences in temperature from the top of the pavement to the bottom of the pavement. Thermal cracks normally manifest as cracks that run transverse to the direction of travel.

Heavy truck loading also causes cracks in the pavement. Radial tires of trucks used in the heavy truck loading impart a tensile force at the outer edge of the radial tires on the surface of the pavement. This tensile force can create a longitudinal crack where the outer edge of the radial tires contacts the pavement. Construction issues may also contribute to longitudinal cracking. Segregation of a pavement mixture may occur from mechanical issues with the paving equipment. The segregation occurs during placement of the material and runs in a direction of the paving equipment.

Generally, the lesser the thickness of the new pavement, the lesser the time before the crack becomes visible in the new pavement. To those skilled in the art, a general rule is that every inch of new pavement provides about one year delay in reflective cracking (i.e. a crack in the existing pavement propagates a crack in the new pavement wherein the crack in the pavement will grow about one inch per year). The generally accepted practice to combat the "one (1) inch per year" crack propagation is to place four (4) inches or more of paving mixture on existing cracked concrete or pavement to keep cracks from appearing for several years. This is an inefficient solution to the problem because of the increased cost and time to lay the paving mixture in amounts that large.

Interlayer type materials are a method of addressing reflective cracking. There are different methods and materials used for constructing an interlayer. One method for constructing an interlayer utilizes applying a heavy application of a liquid binding material followed by an application of an aggregate. This technique was once thought to be limited by the amount of liquid binding material that may be applied without creating flow of the liquid binding material to areas other than intended. It was also once thought that only larger aggregate sizes can be used so as to permit the heavy application of liquid binding material.

Another form of interlayer may involve the placement of a fabric or grid material in a layer of a liquid binding material. The grids or fabrics are challenging to place smoothly, especially when paving is not in a straight line. Grids and fabrics are not intended as a surface for normal traffic. Therefore, grids and fabrics must be covered with a suitable surface material before normal traffic can be resumed. In addition, grids and fabrics are extremely expensive and are relatively slow to construct An alternate form of interlayer may be in the form of an asphalt-aggregate mixture. This technique utilizes high asphalt content in the paving mixture, usually of a highly elastic nature. It was once believed that high asphalt content pavement poses the problem of the liquid binding material flowing from the mixture during manufacture or placement. It was once thought that high asphalt content interlayer mixtures may be sensitive to deformation from traffic and may provide low texture, reduced safety for the motoring public, and/or rutting. Therefore, it is covered with a suitable surface material as soon as possible. In all cases, the interlayer material or process is followed with at least one additional layer of paving material. An example of this type of a suitable surface coating is shown in U.S. Pat. No. 5,069,578, issued to Bense et al. (the Bense et al. patent) on Dec. 3, 1991. The Bense et al. patent provides a relatively thin pavement having a higher asphalt content than was known by those of ordinary skill in the art at the time. One problem with the pavement disclosed in the Bense et al. patent is that the pavement readily cracks in less than about one (1) year. It was once believed that the Bense et al. patent provided the upper limit as to how much asphalt could be used in the pavement and still maintain the stability of the pavement and resist rutting. One factor in the rutting of pavements was believed to be caused by over saturation of the aggregate particles with binding material. It has since come into question where the point of over saturation occurs.

An aggregate material (hot mix asphalt) has a varying percentage of air voids when applied in paving applications. When the aggregate material is used in paving applications with asphalt material, the asphalt material fills a percentage of the air voids present in the aggregate material. In the past, it was believed that about 5% of the air voids of the aggregate material need to remain unfilled to maintain the necessary structure of the pavement and resist rutting.

Accordingly, there remains a need for a method to efficiently create a surface coating having crack and rut resistant properties wherein the crack and rut resistant properties are enhanced to extend the life of the surface coating prior to cracking of the surface while still maintaining stability of the surface coating to allow the safe travel of traffic.

SUMMARY OF THE INVENTION

The present invention provides rut resistant coatings and methods for applying the rut resistant coatings on an existing surface for increasing resistance to high vertical and horizontal strains and high shear stresses. An exemplary method for applying one embodiment of the rut resistant coating according to the invention includes applying a binding material layer of the rut resistant coating on the existing surface to provide a substantially impermeable moisture barrier to the existing surface, the binding material layer containing less than about 11% of the total binding material of the rut resistant coating. After the application of the binding material layer, an aggregate mixture layer is applied on the binding material layer to provide the wear surface of the rut resistant coating and support and structure to the rut resistant coating to resist rutting, the aggregate mixture layer containing an asphalt solution.

DETAILED DESCRIPTION OF THE INVENTION

The present invention relates to a rut resistant coating or interlayer, such as pavement, disposed on an existing surface. Examples of existing surfaces include roads, streets, interstates, parking lots, airport runways, airport taxiways, and the like. The existing surfaces can be constructed of any material known in the art for the above mentioned types of surfaces, such as pavement, jointed Portland concrete cement, and the like. Generally, the existing surfaces have cracks. The rut resistant coating provides resistance to high vertical and horizontal strains caused by deflection of the cracks in the existing surfaces and high shear stresses from traffic, which can cause rutting. More specifically, the rut resistant coating is provided with the ability to maintain stability while at the same time retard the propagation of cracking from the existing surface and rutting.

The rut resistant coating includes a binding material layer and an aggregate mixture layer. The binding material layer is disposed on the existing surface and the aggregate mixture layer is disposed on the binding material layer. The rut resistant coating is a dense bituminous coating mixture wherein the aggregate mixture, with or without fillers, and the binder material when compacted results in a small air void content of the rut resistant coating. The small air void content is less than about 10% of the rut resistant coating.

The binding material layer bonds to the existing surface and provides the existing surface with a substantially impermeable moisture barrier to prevent moisture (i.e. water) from entering the cracks present in the existing surface. The binding material layer also delays raveling and further deterioration of the cracks present in the existing surface. The binding material contains asphalt (or bitumen) and other additives suitable for use in asphalt binding materials, such as sand, polymers, cross-linking agents, vulcanization agents, accelerators, extenders, fluxing agents, and the like. The additives used for fabricating the binding material are selected based on the desired properties of the binding material for a given application of the rut resistant coating.

The binding material can also be in the form of a polymer modified asphalt emulsion (PMAE), a hot asphalt cement, a petroleum solvent cutback asphalt, and the like. When a liquid asphalt emulsion is used as the binding material, the asphalt emulsion can be formulated to have a low viscosity. The low viscosity of the asphalt emulsion thereby aids the asphalt emulsion's ability to penetrate the aggregate mixture of the rut resistant coating. In addition, the asphalt emulsion may be provided with an elastomeric type polymer to add flexibility to resist reflective cracking. Suitable elastomers are described in U.S. Pat. No. 4,242,246, issued to Maldonado et al. on Dec. 30, 1980, the entirety of which is hereby incorporated herein by reference.

The aggregate mixture layer provides support and structure to the rut resistant coating to resist rutting. Additionally, the aggregate mixture layer provides a wear surface maintaining adequate texture for traffic safety and resistance to rutting.

The aggregate mixture of the aggregate mixture layer contains aggregate particles, an asphalt solution, and optionally, a pulverulent material. The aggregate particles can be sized and shaped so as to provide sufficient structure and support thereby resisting the formation of ruts in the rut resistant coating. Examples of aggregate particles include stone chips, gravel, recycled asphalt Pavement (RAP), and combinations thereof. Although some examples of aggregate particles are described herein, it should be understood and appreciated that the aggregate particles used in accordance with the present invention can be any suitable material known in the art for use as aggregate particles in asphalt paving applications.

The pulverulent material is added to the aggregate mixture to provide a more densely graded aggregate and reduce the amount of air voids present in the aggregate mixture and thus the rut resistant coating. Additionally, the pulverulent material mixes with the asphalt solution and provide a pasty consistency to an adhesive layer on the aggregate particles. The addition of pulverulent material also reduces the asphalt solution's tendency to flow from the aggregate particles due to the asphalt solution's fluid nature when heated. The pulverulent material can be any suitable material known in the art for use as pulverulent material in asphalt paving applications. Examples include, but are not limited to, stone powder and fine sand. The pulverulent material can be present in the aggregate mixture in any amount sufficient to reduce the air voids and provide the necessary consistency to the adhesive layer of the aggregate particles The asphalt solution can be any type of bituminous material known in the art. Examples of bituminous materials include petroleum based asphalt, asphalt cement (AC), pitch, coal tar, asphalt, vacuum tower bottoms (VTB), resid, performance grade (PG) asphalts, flux, petroleum products, non-petroleum based products, and combinations thereof.

The asphalt solution contained in the aggregate mixture may coat a portion of the aggregate particles or coat substantially all of the aggregate particles to create a hot-mix asphalt (HMA). The aggregate mixture is considered a HMA when the temperature of the aggregate mixture is greater than about 110° C. (230° F.). In an alternative embodiment of the present invention, the aggregate mixture is provided in the form of a "warm" mix. The aggregate mixture is considered a "warm" mix when the temperature of the aggregate mixture is in a range of from an ambient temperature to about 100° C. (212° F.). In another embodiment of the present invention, the aggregate mixture is provided in the form of a "cold" mix. The aggregate mixture is considered a "cold" mix when the temperature of the aggregate mixture is about an ambient temperature. It should be understood and appreciated that the ambient temperature can be the ambient air temperature anywhere the aggregate mixture is produced and/or used. It should also be understood and appreciated that the asphalt solution contained in the aggregate mixture can be the same as any embodiment of the binding material in the binding material layer described herein. It should further be understood and appreciated that the asphalt solution contained in the aggregate mixture and the binding material in the binding material layer are combined to represent a total binder material of the rut resistant coating.

The binding material can be present in the binding material layer in an amount sufficient to allow the rut resistant coating to withstand movement and cycles of movement (i.e. flexing) without cracking or permitting rutting in the rut resistant coating. In one embodiment of the present invention, the binding material contained in the binding material layer is less than about 11% of the total binder material of the rut resistant coating.

The asphalt solution is present in the aggregate mixture in an amount sufficient to bind the aggregate particles together yet not destroy the structure and support provided by the aggregate mixture layer to resist rutting. In one embodiment of the present invention, the asphalt solution is present in the aggregate mixture in an amount greater than about 89% of the total binder material of the rut resistant coating.

In use, the rut resistant coating is applied on the existing surface to increase resistance to high vertical and horizontal strains, high shear stresses, and rutting. The binding material layer of the rut resistant coating is disposed on the existing surface in an amount sufficient to allow the rut resistant coating to withstand movement and cycles of movement (i.e. flexing) without cracking and/or rutting. In one embodiment of the present invention, the binding material of the binding material layer is disposed on the existing surface in a range of less than about 0.40 gallons per sq. yd. (1.81 liters per sq. m). In another embodiment of the present invention, the binding material of the binding material layer is disposed on the existing surface in a range of less than about 0.30 gal. per sq. yd. (1.38 l per sq. m). In a further embodiment of the present invention, the binding material of the binding material layer is disposed on the existing surface in a range of less than about 0.16 gal. per sq. yd. (0.72 l per sq. m). The amount of binding material of the binding material layer disposed on the existing surface is known herein as the binding material rate.

The aggregate mixture of the aggregate mixture layer can then be added in an amount sufficient to provide a substantially uniform thickness of the rut resistant coating to further provide the rut resistant coating with the crack reflective and rut resistant properties. In one embodiment of the present invention, the aggregate mixture of the aggregate mixture layer is provided in an amount sufficient to provide the rut resistant coating having a thickness in a range of less than about 4 in. (10.16 cm). In another embodiment of the present invention, the aggregate mixture of the aggregate mixture layer is provided in an amount sufficient to provide the rut resistant coating with a thickness (or depth) in a range of less than about 2 in. (5.08 cm). In a further embodiment of the present invention, the aggregate mixture of the aggregate mixture layer is provided in an amount sufficient to provide the rut resistant coating with a thickness (or depth) in a range of less than about 1.5 in, (3.81 cm). In another embodiment of the present invention, the aggregate mixture of the aggregate mixture layer is provided in an amount sufficient to provide the rut resistant coating with a thickness (or depth) in a range of less than about 1 in. (2.54 cm).

The aggregate mixture of the aggregate mixture layer is disposed on the binding material layer within a specific amount of time such that the binding material of the binding material layer does not run off (or flow from) the existing surface where the rut resistant coating is being applied. In one embodiment of the present invention, the aggregate mixture of the aggregate mixture layer is disposed on the binding material layer in a period of time less than about 30 seconds. In another embodiment of the present invention, the aggregate mixture of the aggregate mixture layer is disposed on the binding material layer in a period of time less than about 20 seconds. In a further embodiment of the present invention, the aggregate mixture of the aggregate mixture layer is disposed on the binding material layer in a period of time less than about 15 seconds. In yet another embodiment of the present invention, the aggregate mixture of the aggregate mixture layer is disposed on the binding material layer in a period of time less than about 5 seconds.

In one embodiment of the present invention, the asphalt solution (i.e. bituminous material) described herein is present in the aggregate mixture of the aggregate mixture layer in an amount sufficient to further provide the rut resistant coating with the crack reflective and rut resistant properties.

The binding material described herein fills the voids within the aggregate mixture of the aggregate mixture layer to the extent that the rut resistant coating resists rutting and is resistant to the propagation of the cracks in the existing surface for at least about two years.

The amount of voids in the rut resistant coating that are filled with binding material is determined by measuring the percentage of the depth (or height) of the rut resistant coating that is flooded with binding material. In one embodiment of the present invention, the percentage of the depth of the rut resistant coating that is flooded with binding material is in a range of greater than about 40%. In another embodiment of the present invention, the percentage of the depth of the rut resistant coating that is flooded with binding material is in a range of greater than about 60%.

After the aggregate mixture layer is applied to the binding material layer, the aggregate mixture layer may be compacted against the binding material layer. Compacting the aggregate mixture layer against the binding material layer provides a substantially uniform thickness of the aggregate mixture layer and the binding material layer. In addition, compacting the aggregate mixture layer and the binding material layer reduces void space in the aggregate mixture layer by forcing the binding material of the binding material layer into the voids existing in the aggregate mixture layer. Additionally, compacting the aggregate mixture layer against the binding material layer promotes the adhesion of the aggregate mixture layer to the binding material layer. Finally, compacting the aggregate mixture layer provides a smoother wearing surface, which is quieter and safer for public travelers and is more resistant to rutting.

Several embodiments of the rut resistant coating of the present invention were tested to determine its resistance to rutting. Each embodiment of the rut resistant coating's resistance to rutting was measured using a Hamburg Wheel-tracking Test (HWT). More specifically, each rut resistant coating's resistance to rutting was measured using the Texas Department of Transportation (TxDOT) method for HWT. The TxDOT method for HWT ultimately uses cylindrical cores having a width of 150 mm (6 in.) and a height of 60 mm (2⅜ in.) for the testing. The cores are heated to 50° C. (122° F.) for the HWT. The cores can be constructed by placing any embodiment of the rut resistant coating over any existing surface, thus the cores will consist a portion of the height consisting primarily of the existing surface and a portion of the height consisting primarily of the rut resistant coating of the present invention.

In addition to determining the rut resistant coating's resistance to rutting, the bond strength ($lb_f$) of the rut resistant coatings were determined. Bond strength test equipment was used to determine the bond strength of various embodiments of the rut resistant coating. The bond strength test is used to determine the bond strength between two layers of pavement material. The bond strength may be used as an indicator of how well the pavement layers will adhere to each other. Low bond strength values may be an indicator that layer slippage may occur or possible delamination from the existing surface. The bond strength may also be used as a method to compare different binding layer materials (or tack coat material) or application rates of tack coat materials. The bond strength testing can be done according to ASTM standards D 6925 [Preparation and Determination of the Relative Density of Hot Mix Asphalt (HMA) Specimens by Means of the Superpave Gyratory Compactor (SGC)], D 979 (Sampling Bituminous Paving Mixtures), and D 5361 (Sampling compacted Bituminous Mixtures for Laboratory Testing), the entirety of which are hereby expressly incorporated herein by reference.

For bond strength testing, the cores are manipulated so that the portion of the height consisting primarily of the existing surface is in a range of at least about 50 mm (2 in.) so as to be able to grip the core. The cores are heated to 40° C. (104° F.) for the bond strength test. The bond strength of the rut resistant coating can be any bond strength such that the rut resistant coating is provided in accordance with any embodiment of the present invention. In one embodiment of the present invention, the bond strength of the rut resistant coating can be in a range of from about 185 $lb_f$ to about 325 $lb_f$.

The HWT and the bond strength test were performed for cores having binding material rates of 0.1 gal. per sq. yd., 0.2 gal. per sq. yd., and 0.3 gal. per sq. yd. For each binding material rate, the aggregate mixture was supplied so as to provide the rut resistant coating with depths ranging from about 1.25 in. to about 2.75 in. For each binding material rate, the average number of passes to reach a rut depth of 12.5 mm using the HWT and the average bond strength were determined and are listed in Table 1 below.

TABLE 1

| Percentage of Total Binder in the Binding Material Layer | Binding Material Rate (gal. per sq. yd.) | Number of Passes to Reach 12.5 mm Rut Depth | Bond Strength ($lb_f$) |
|---|---|---|---|
| 4.2% | 0.1 | 4275 | 248.2 |
| 7.6% | 0.2 | 5950 | 274.2 |
| 11.0% | 0.3 | 7650 | 194.1 |

NOTE:
The percentage of total binder in the binding material layer is based on 6% asphalt in the hot mix layer and emulsion by weight of the hot layer and emulsion at 65% residue.

It should be understood and appreciated that any embodiment of the rut resistant coating described herein can be implemented in the method for applying the rut resistant coating to the existing surface described above. It should also be understood and appreciated that any embodiment of the rut resistant coating described herein can be mixed, transported, applied, and compacted using standard surface coating equipment know to one of ordinary skill in the art, such as that described in U.S. Pat. No. 5,069,578 and French Patent No. 2,550,248, both of which are hereby incorporated by reference.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed is:

1. A method for applying a rut resistant coating on an existing surface for increasing resistance to high vertical and horizontal strains and high shear stresses, comprising the steps of:

applying a binding material layer of the rut resistant coating on the existing surface to promote bonding of the rut resistant coating to the existing surface, the binding material layer containing less than about 11% of the total binding material of the rut resistant coating; and applying an aggregate mixture layer containing an asphalt solution on the binding material layer to provide a wear surface to the rut resistant coating to resist rutting, wherein the aggregate mixture of the aggregate mixture layer is disposed on the binding material layer in a period of time less than about 30 seconds.

2. The method of claim 1 wherein the aggregate mixture of the aggregate mixture layer is disposed on the binding material layer in a period of time less than about 20 seconds.

3. The method of claim 1 wherein the aggregate mixture of the aggregate mixture layer is disposed on the binding material layer in a period of time less than about 15 seconds.

4. The method of claim 1 wherein the aggregate mixture of the aggregate mixture layer is disposed on the binding material layer in a period of time less than about 5 seconds.

5. The method of claim 1 further comprising the step of compacting the aggregate mixture layer against the binding material layer, the step of compacting the aggregate mixture layer against the binding material layer provides a substantially uniform thickness of the aggregate mixture layer and the binding material layer, reduces void space in the aggregate mixture layer, and promotes adhesion of the aggregate mixture layer to the binding material layer.

6. The method of claim 1 wherein the aggregate mixture includes a pulverulent material to mix with the asphalt solution to produce a pasty layer to promote adhesion of the aggregate mixture.

7. The method of claim 6 wherein the pulverulent material is selected from the group consisting of stone powder and fine sand.

8. The method of claim 1 wherein the binding material of the binding material layer is applied on the existing surface in an amount in a range of less than about 1.81 l per sq. m.

9. The method of claim 1 wherein the binding material of the binding material layer is applied on the existing surface in an amount in a range of less than about 1.38 l per sq. m.

10. The method of claim 1 wherein the binding material of the binding material layer is applied on the existing surface in an amount in a range of less than about 0.72 l per sq. m.

11. The method of claim 1 wherein the rut resistant coating is bonded to the existing surface at a specific bond strength.

12. The method of claim 11 wherein the bond strength is in a range of from about 185 $lb_f$ to about 325 $lb_f$.

13. A rut resistant coating disposed on an existing surface to provide resistance to high vertical and horizontal strains and high shear stresses, the coating having a wear surface for traffic, comprising:

a binding material layer disposed on the existing surface by promote bonding of the rut resistant coating to the existing surface, the binding material layer containing less than about 11% of the total binding material of the rut resistant coating; and an aggregate mixture layer containing an asphalt solution disposed on the binding material layer to provide the wear surface and support and structure to the rut resistant coating to resist rutting, wherein the aggregate mixture of the aggregate mixture layer is disposed on the binding material layer in a period of time less than about 30 seconds.

14. The coating of claim 13 wherein the aggregate mixture includes a pulverulent material.

15. The coating of claim 14 wherein the pulverulent material is selected from the group consisting of stone powder and fine sand.

16. The coating of claim 13 wherein the binding material of the binding material layer is applied on the existing surface in an amount in a range of less than about 1.81 l per sq. m.

17. The coating of claim 13 wherein the binding material of the binding material layer is applied on the existing surface in an amount in a range of less than about 1.38 l per sq. m.

18. The coating of claim 13 wherein the binding material of the binding material layer is applied on the existing surface in an amount in a range of less than about 0.72 l per sq. m.

19. The coating of claim 13 wherein the rut resistant coating is bonded to the existing surface at a specific bond strength.

20. The coating of claim 19 wherein the bond strength is in a range of from about 185 $lb_f$ to about 325 $lb_f$.

21. The coating of claim 13 wherein the aggregate mixture of the aggregate mixture layer is disposed on the binding material layer in a period of time less than about 20 seconds.

22. The coating of claim 13 wherein the aggregate mixture of the aggregate mixture layer is disposed on the binding material layer in a period of time less than about 15 seconds.

23. The coating of claim 13 wherein the aggregate mixture of the aggregate mixture layer is disposed on the binding material layer in a period of time less than about 5 seconds.

* * * * *

UNITED STATES PATENT AND TRADEMARK OFFICE
Certificate

Patent No. 7,802,941 B2 Patented: September 28, 2010

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jon Brett Wingo, Broken Arrow, OK (US); Marvin Keller Exline, Terre Haute, IN (US); James Joseph Cunningham, Jr., Greensburg, PA (US); and James J. Barnat, Tulsa, OK (US).

Signed and Sealed this Twenty-sixth Day of February 2013.

THOMAS B. WILL
*Supervisory Patent Examiner*
Art Unit 3671
Technology Center 3600